US005171171A

United States Patent [19]

Tani

[11] Patent Number: 5,171,171

[45] Date of Patent: Dec. 15, 1992

[54] KILL SWITCH ASSEMBLY FOR SMALL WATERCRAFT

[75] Inventor: Satoshi Tani, Iwata, Japan

[73] Assignee: Yamaha Hatsudoki Kabushiki Kaisha, Iwata, Japan

[21] Appl. No.: 713,634

[22] Filed: Jun. 10, 1991

Related U.S. Application Data

[63] Continuation of Ser. No. 457,549, Dec. 27, 1989, abandoned.

[30] Foreign Application Priority Data

Dec. 28, 1988 [JP] Japan ..... 63-333769

[51] Int. Cl.[5] ..... B63H 21/21

[52] U.S. Cl. ..... 440/1; 114/270; 180/272; 440/84; 440/85

[58] Field of Search ..... 440/1, 84, 85; 180/272; 114/270, 87; 200/331, 334, 338, 543

[56] References Cited

U.S. PATENT DOCUMENTS

| | | | |
|---|---|---|---|
| 1,881,251 | 10/1932 | Tobener | 440/84 |
| 3,371,646 | 3/1968 | Mela | 114/270 |
| 3,801,767 | 4/1974 | Marks | 180/272 |
| 3,957,131 | 5/1976 | Perkins | 180/272 |
| 4,037,683 | 7/1977 | LeBell | 180/272 |
| 4,458,115 | 7/1984 | Peterson | 440/87 |
| 4,743,213 | 5/1988 | Nishida | 440/1 |
| 4,762,968 | 8/1988 | Hilton | 200/543 |

FOREIGN PATENT DOCUMENTS

| | | | |
|---|---|---|---|
| 112393 | 9/1981 | Japan | 440/84 |
| 291293 | 12/1986 | Japan | 441/75 |
| 229796 | 9/1989 | Japan | 440/84 |

*Primary Examiner*—Sherman Basinger
*Assistant Examiner*—Thomas J. Brahan
*Attorney, Agent, or Firm*—Ernest A. Beutler

[57] ABSTRACT

An improved kill switch assembly is provided for a small watercraft which is powered by an engine and operated by a watercraft control, preferably in the form of a handlebar assembly. The kill switch and its associated actuating button are adapted to be mounted on the watercraft control or handlebar assembly of the watercraft so as to follow an apendage of the operator during operation of the watercraft. In the preferred embodiment, a cord assembly operably connects the actuating button to the operator's arm. The kill switch assembly is designed so that the actuating button is released to stop the engine if the operator falls overboard, but is adapted to greatly reduce the chance of inadvertent release of the actuating button to stop the engine due to the operator's movements while on board the watercraft.

9 Claims, 5 Drawing Sheets

KILL SWITCH ASSEMBLY FOR SMALL WATERCRAFT

This is a continuation of U.S. Pat. application Ser. No. 07/457,549, filed Dec. 27, 1989, now abandoned.

BACKGROUND OF THE INVENTION

This invention relates to a kill switch assembly for a small watercraft, and more particularly to an improved kill switch assembly wherein the kill switch actuating button is mounted on the handlebar assembly of the watercraft so as to follow the operator during operation of the watercraft.

A popular type of small watercraft is of the jet propulsion type and is designed to accommodate primarily a single rider seated in straddle fashion or standing and who operates and steers the watercraft using a handlebar assembly mounted on the rearward portion of the watercraft's control bridge. Some watercraft of the jet propulsion type include a raisable steering mast which is pivotally secured to the watercraft at its lower end for movement between a substantially horizontal position and an upright position In this latter style of small watercraft a handlebar assembly is supported on the upper end of the steering mast so that the watercraft can be operated when the steering mast is in an upward position by an operator in the standing position.

These small watercrafts, whether having a handlebar assembly mounted on the control bridge or a handlebar assembly supported on a raisable steering mast, are frequently provided with certain controls for the engine such as an electric starter control, and a kill switch that stops the engine if the operator becomes displaced from the watercraft. This kill switch acts as a safety device by insuring that the watercraft cannot be operated unless the operator is in position. Often times, this kill switch and its associated actuating button are mounted on the control bridge and are operably connected to the operator.

Such an arrangement is shown in FIGS. 7, 8 and 9 wherein, the kill switch actuating button 31 is mounted on the rearward portion of the control bridge 18 and is operably connected to the operator 16 by means of a cord assembly 33. When the operator 16 is displaced from the watercraft 10 the actuating button 31 is released and the engine is stopped However, as may be seen, this type of arrangement may also result in the inadvertent release of the kill switch actuating button 31 to stop the engine even if the operator 16 has not become displaced, since the actuating button 31 is not positioned to follow the operator 16 through his or her steering or operating movements.

When the actuating button 31 is positioned on the control bridge 18 and a cord assembly 33 is used to operably connect the actuating button 31 to the operator's jacket or waist belt 17 via a strap 32, as shown in FIGS. 7 and 8, the increased tension placed on the cord assembly 33 during steering movement of the handlebar assembly 19 may cause the cord assembly 33 to disconnect from the actuating button 31 thereby releasing it and causing the engine to shut off. Increased tension will be also be placed on the cord assembly 33 when the operator 16 stands up or assumes a more rearwardly position, as shown in FIG. 8. This, too, may result in the inadvertent release of the actuating button 31 to stop the engine.

The cord assembly 33 may also be used to operably connect the actuating button 31, which is mounted on the control bridge 18, to the operator's arm or wrist. This type of arrangement is depicted in FIG. 9, although the operator is omitted in the drawing. The disadvantage with this arrangement is that movement of the handlebar assembly 19, as shown in FIG. 9, will place more tension on the cord assembly 33. As a result, the cord assembly 33 may be disconnected from the actuating button 31, causing it to release and inadvertently shut off the engine.

It is, therefore, a principal object of this invention to provide an improved kill switch assembly which acts to stop the engine when the operator is displaced from the watercraft but greatly reduces the chance that the engine will inadvertently be shut off during normal operation of the watercraft.

SUMMARY OF THE INVENTION

A kill switch assembly is provided for a small watercraft powered by an engine and having a watercraft control, preferably in the form of a handlebar assembly which is operable by an appendage of an operator. The kill switch is mounted on the watercraft control so as to follow the operator's appendage during operation of the watercraft. Means for operating the kill switch are provided, preferably in the form of an actuating button and a cord assembly which operably connects the kill switch actuating button to the operator's appendage so as to stop the engine if the operator is displaced from the watercraft. In the preferred embodiment the cord assembly includes a spacer piece with a slot for selective engagement with the actuating button so as to hold the button in an open position during normal operation of the watercraft but to permit release of the button to stop the engine if the spacer piece is disengaged from the actuating button which will occur when the operator is displaced from the watercraft.

DETAILED DESCRIPTION OF THE PREFERRED EMBODIMENT

Figure 1:
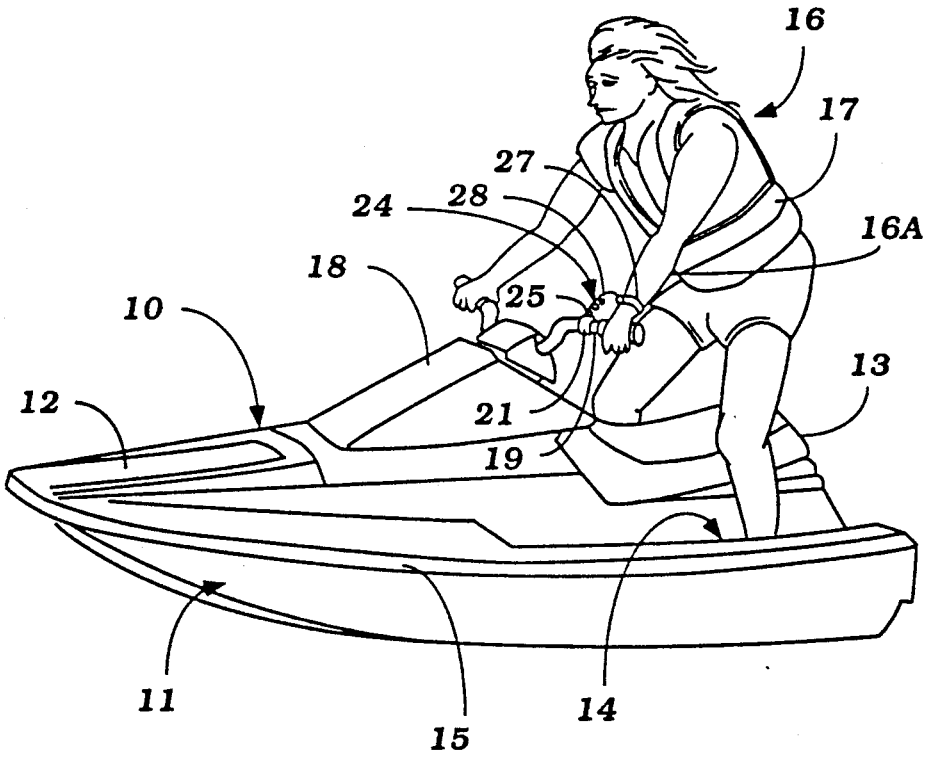
FIG. 1 is a side elevational view of a small watercraft with an operator thereon and constructed in accordance with the invention.
Figure 2:
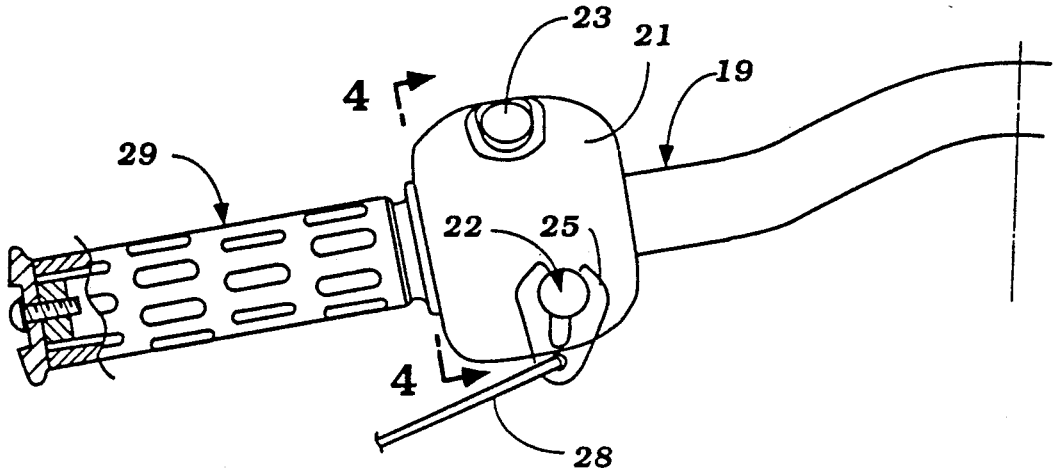
FIG. 2 is a rear elevational view showing a control box affixed to the handlebar assembly and the kill switch actuating button positioned thereon and being held in the open position by the spacer piece.
Figure 3:
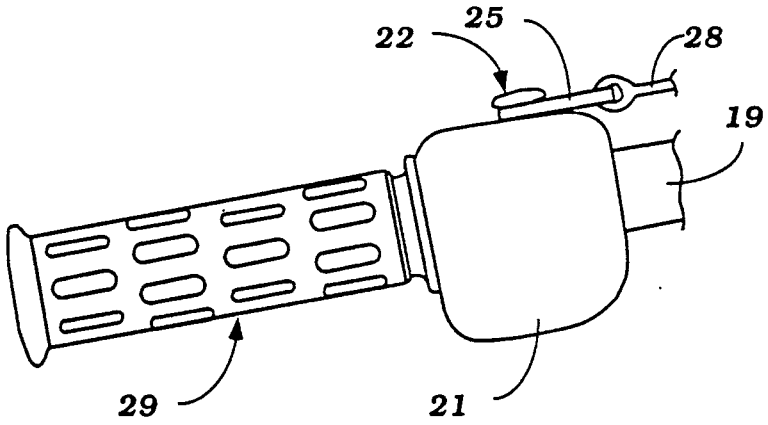
FIG. 3 is a rear view of the control box and parts of the kill switch assembly.
Figure 4:
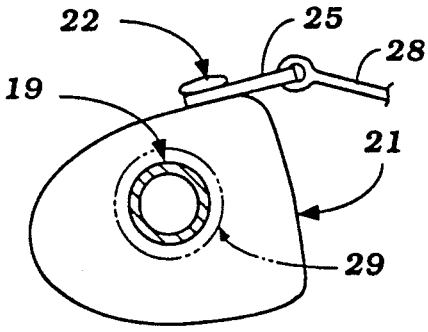
FIG. 4 is a cross sectional view taken along line IV—IV of FIG. 2.
Figure 5:
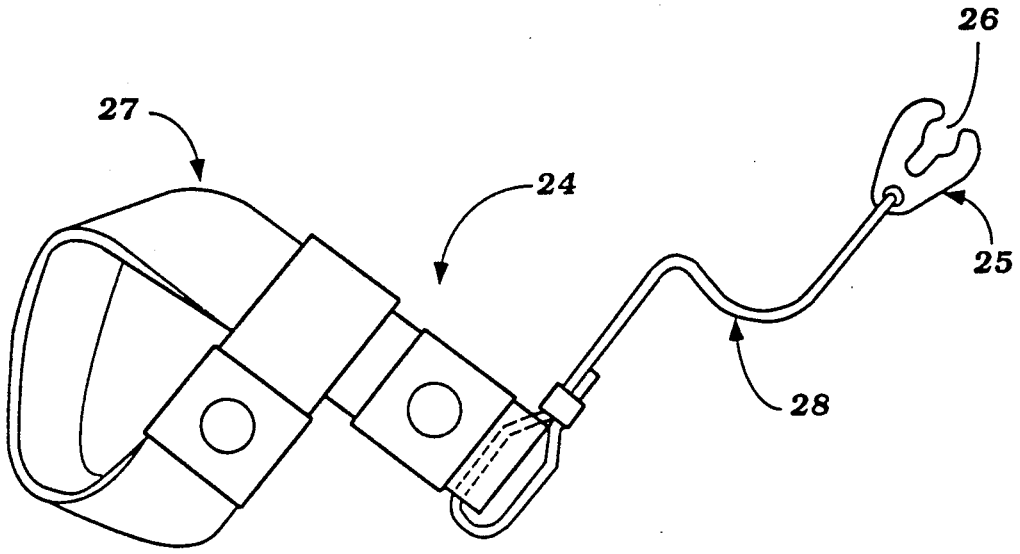
FIG. 5 is a detailed view of the cord assembly of this invention.
Figure 6:
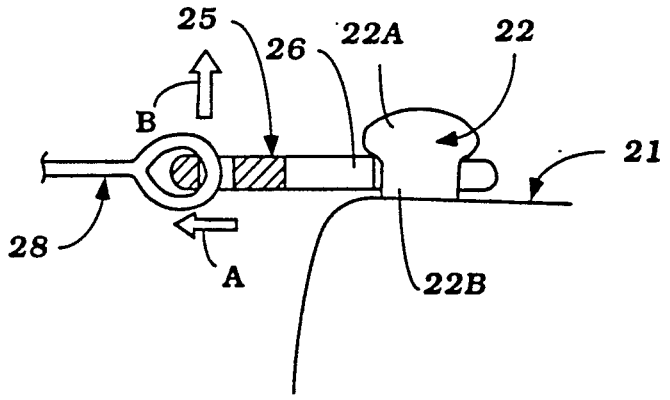
FIG. 6 is a side elevational view of the control box and parts of the kill switch assembly
Figure 7:
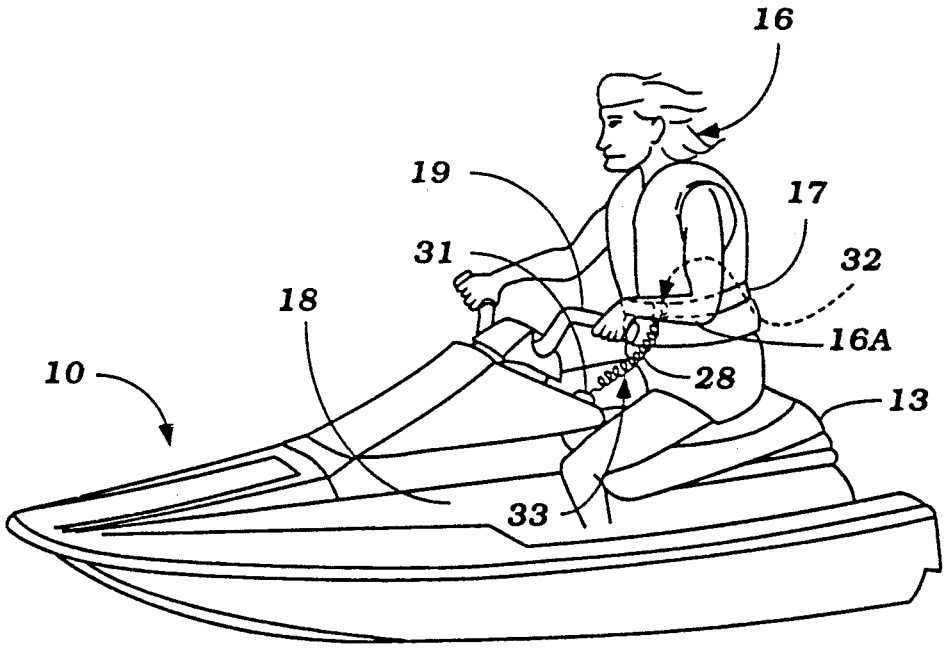
FIG. 7 is a side elevational view of a small watercraft with an operator seated thereon and having a prior art type of construction.
Figure 8:
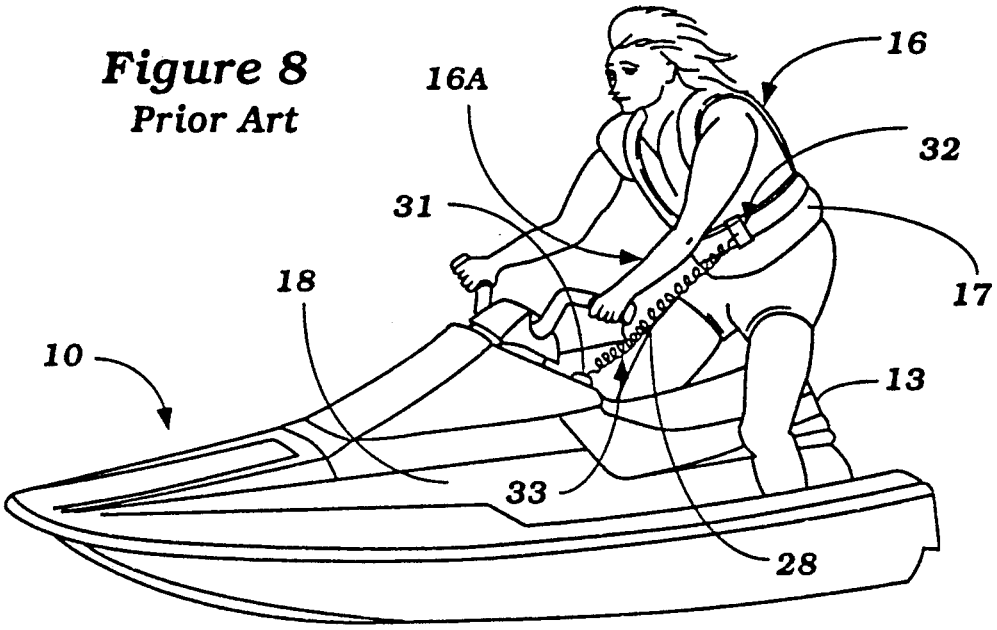
Figure 8 Prior Art
FIG. 8 is a side elevational view of a small watercraft with an operator in a standing position and having a prior art type of construction.
Figure 9:
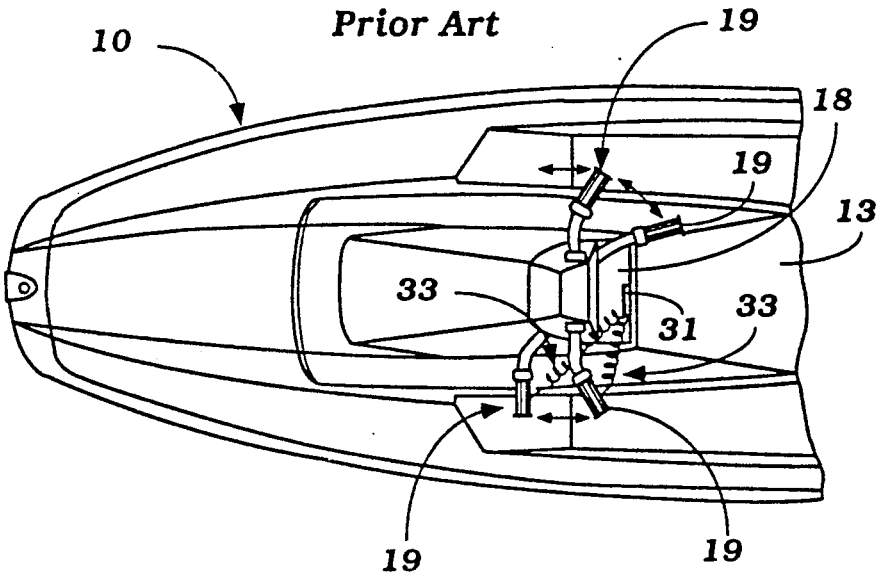
Figure 9 Prior Art
FIG. 9 is a top plan view of a small watercraft of the prior art type of construction.

Referring first to FIG. 1, a small watercraft constructed in accordance with the invention is identified generally by the reference numeral 10. The watercraft 10 is comprised of a hull having a lower portion 11 and a deck portion 12 each of which may be formed conveniently from a molded fiberglass reinforced plastic as is well known in this art. A seat 13 is provided rearward of the deck 12 and has a pair of depressed foot areas 14 that are disposed on opposite sides thereof and which are positioned inwardly of raised funnels 15. As may be seen in FIG. 1, an operator, identified generally by the reference numeral 16, may stand with his feet in the depressed foot areas 14 during operation of the watercraft 10 Alternatively, the operator 16 may be seated on seat 13 during operation of the watercraft 10. The operator 16 is depicted as wearing a jacket 17 which can also act as a life preserver The operator 16 is shown with one end of a cord assembly 24 attached to his arm 16A. The cord assembly 24 is used to operate a kill switch actuating button 22 as hereinafter described.

A control bridge 18 is provided forwardly of the seat 13 on the deck 12 and an internal combustion engine (not shown) is positioned beneath the bridge 18 within an engine compartment formed by the lower hull portion 11 and the deck 12. This internal combustion engine drives a jet propulsion unit (not shown) which is positioned within a tunnel formed at the rear of the hull beneath the seat 13. The jet propulsion unit may be of any known type but includes a pivotally supported discharge nozzle (not shown) which pivots about a vertically extending axis for steering purposes as is well known in this art.

A watercraft control in the form of a handlebar assembly 19 is carried on a rearward portion of the bridge 18 forwardly of the seat 13 and in a position wherein the operator 16 may conveniently grasp the handlebar assembly 19 to steer the discharge nozzle. As is common in this art, a steering lever extends outwardly from one side of the discharge nozzle and is connected by means of a bowden wire to a steering arm formed at the lower end of the handlebar assembly 19 for steering of the watercraft 10.

Referring now to FIGS. 2 through 6, a control box 21 is designed so as to be detachably affixed to the handlebar assembly 19 for operation of the watercraft 10 and control of certain of its functions A kill switch of a kill switch assembly is supported within a top face of the control box 21 so as to follow the operator 16. The kill switch has an actuating button 22 mounted on a top face of the control box 21 that can be released so as to stop the engine. A starter switch is also supported within a top face of the control box 21 and has an actuating button 23 that can be operated by the finger of the operator 16 and which will also stop the engine in a suitable manner. These switches communicate with the engine through externally positioned wires in a known manner.

The kill switch assembly further includes a cord assembly 24 for operably connecting the kill switch actuating button 22 to the operator's arm 16A so that if the operator is displaced from the watercraft 10 the cord assembly 24 is disconnected from the actuating button 22 and the button 22 is released to stop the engine.

The cord assembly 24 includes a spacer piece 25 having a slot therein 26 for selective engagement with the kill switch actuating button 22. In the preferred embodiment, the spacer piece 25 is inserted between a top face of the control box 21 and a head portion of the kill switch actuating button 22A so that a neck portion of the actuating button 22B engages with the slot 26 of the spacer piece 25. The head portion 22A is of generally greater diameter than the neck portion 22B so that when the spacer piece 25 is inserted between the top face of the control box 21 and the actuating button's head portion 22A the spacer piece 25 holds the actuating button 22 in an open or up position to permit normal operation of the watercraft 10.

The cord assembly 24 further includes a strap 27 which is releasably attachable to the operator's arm 16A. The strap 27 is connected to the spacer piece 25 by means of a cord 28 so that spacer piece 25 to disengage and be withdrawn from the kill switch actuating button 22. This will cause the actuating button 22 to be released to a closed or down position to stop the engine. Such a kill switch assembly provides for ease of reentry by the operator 16 and also acts as a safety device to prevent operation of the watercraft 10 unless the operator 16 is in position.

Because the kill switch actuating button 22 is positioned on the handlebar assembly 19 rather than on the control bridge 18, the chance of inadvertent release of the actuating button 22 to stop the engine due to steering movement of the handlebar assembly 19 or movement by the operator 16 is considerably less than with the prior art constructions.

The handlebar assembly 19 further includes a pair of handlebar grips 29, one mounted on each end of the handlebar assembly 19 to permit easy operation and steering of the watercraft 10 by the operator 16.

It should be readily apparent from the foregoing description that the embodiment of the invention is well suited to fulfill the objects aforenoted. Although this is the case, various changes and modifications may be made without departing from the spirit and scope of the invention as defining by the appended claims.

I claim:

1. A kill switch assembly for a small watercraft powered by an engine and having a watercraft control operable by an arm of an operator, comprising a handlebar assembly including a handlebar, at lest one handlebar grip mounted on one end of said handlebar and having an outer peripheral surface positioned radially outward from said handlebar and a control box including an actuating switch means, said control box mounted on said handlebar adjacent said handlebar grip and having an outer peripheral surface, a kill switch supported on the outer peripheral surface of said control box and having a portion positioned radially outward from said handlebar grip from said handlebar so as to follow the opertor's lower arm through steering movements and means for operating said kill switch to stop said engine if the operator is displaced from said watercraft, said operating means operably connecting said skill switch to the lower arm of the operator.

2. A kill switch assembly as recited in claim 1, wherein said means for operating said kill switch includes an actuating button having a neck portion and a head portion of generally greater diameter than said neck portion, said actuating button being moveable between an open position and a closed position wherein said engine is stopped.

3. A kill switch assembly as recited in claim 2, wherein said operating means comprises a cord assembly, including a spacer piece having a slot therein for selective engagement with said actuating button so as to hold said actuating button in said open position during normal operation of said watercraft but to permit release of said actuating button to stop said engine if said spacer piece is disengaged from said actuating button.

4. A kill switch assembly as recited in claim 3, wherein said cord assembly further includes a strap releasably attachable to the lower arm of the operator and a cord connecting said strap with said spacer piece such that if the operator is displaced from said watercraft said spacer piece is disengaged from said actuating button to stop said engine.

5. A kill switch assembly as recited in claim 1, wherein said control box has a top face on its outer peripheral surface and said kill switch is supported within the top face of said control box.

6. A kill switch assembly as recited in claim 5, wherein said means for operating said kill switch includes an actuating button having a neck portion and a head portion of generally greater diameter than said neck portion, said actuating button being moveable between an open position and a closed position wherein said engine is stopped.

7. A kill switch assembly s recited in claim 1, wherein said control box has a larger diameter than said adjacent handlebar grip and said handlebar.

8. A kill switch assembly as recited in claim 7, wherein said actuating switch means is mounted on said control box next to said kill switch in the circumferential direction.

9. A kill switch assembly as recited in claim 1, wherein said actuating switch means is mounted on said control box next to said kill switch in the circumferential direction.

* * * * *

UNITED STATES PATENT AND TRADEMARK OFFICE

CERTIFICATE OF CORRECTION

PATENT NO. : 5,171,171

DATED : December 15, 1992

INVENTOR(S) : Satoshi Tani

It is certified that error appears in the above-identified patent and that said Letters Patent is hereby corrected as shown below:

Abstract line 7, "apendage" should be --appendage--.

Column 4, line 41, Claim 1, "lest" should be --least--.

Column 4, line 50, Claim 1, after "handlebar" (first occurrence) insert --at a distance greater than the radially outward distance of the outer peripheral surface of said handlebar--.

Column 4, line 54, Claim 1, "skill" should be --kill--.

Column 6, line 5, Claim 7, "s" should be --as--.

Signed and Sealed this

Twenty-third Day of November, 1993

*Attest:*

Bruce Lehman

BRUCE LEHMAN

*Attesting Officer*

*Commissioner of Patents and Trademarks*